US006663479B2

(12) United States Patent
Sendelbeck

(10) Patent No.: US 6,663,479 B2
(45) Date of Patent: Dec. 16, 2003

(54) CONTOURING HAND SANDER TOOL

(76) Inventor: Robert Lee Sendelbeck, 3505 Laguna Ave., Palo Alto, CA (US) 94306

( * ) Notice: Subject to any disclaimer, the term of this patent is extended or adjusted under 35 U.S.C. 154(b) by 0 days.

(21) Appl. No.: 10/141,204

(22) Filed: May 9, 2002

(65) Prior Publication Data

US 2002/0187736 A1 Dec. 12, 2002

Related U.S. Application Data

(60) Provisional application No. 60/292,442, filed on May 21, 2001.

(51) Int. Cl.[7] ..... B24D 15/00

(52) U.S. Cl. ..... 451/523; 451/504; 451/512; 451/514; 451/516; 451/517

(58) Field of Search ..... 451/495, 513, 451/523, 524, 514, 516, 517, 504, 512

(56) References Cited

U.S. PATENT DOCUMENTS

| | | | | | |
|---|---|---|---|---|---|
| 573,364 | A | * | 12/1896 | Simonds | |
| 2,009,704 | A | * | 7/1935 | Powell | |
| 2,400,928 | A | | 5/1946 | Hein | 51/187 |
| 2,457,045 | A | * | 12/1948 | Kitterman | |
| 2,457,466 | A | | 12/1948 | Hanna | 51/185 |
| 2,493,852 | A | | 1/1950 | Bonkowski | 51/187 |
| 2,531,588 | A | * | 11/1950 | Stucker | |
| 2,761,257 | A | | 9/1956 | Mendelson | 51/186 |
| 2,871,630 | A | | 2/1959 | Whitlock | 51/187 |
| 3,063,208 | A | | 11/1962 | Bell and Gellasch | 51/187 |
| 3,106,806 | A | | 10/1963 | Hutchins | 51/187 |
| 4,475,317 | A | * | 10/1984 | Dicke | |
| 4,730,430 | A | | 3/1988 | Petrovich | 51/387 |
| 5,172,524 | A | | 12/1992 | Poss | 51/372 |
| 5,383,308 | A | | 1/1995 | Beloff | 451/519 |
| 6,213,857 | B1 | * | 4/2001 | Duquette | 451/513 |

* cited by examiner

*Primary Examiner*—Eileen P. Morgan

(57) ABSTRACT

A hand held tool using continuous sanding belts for sanding and smoothing flat surfaces with the additional capability to produce more uniformly rounded edges and corners of various work pieces. Its two piece construction comprises a flat base plate rotationally attached to the bottom side of a housing. The housing has along the length of its top side a deep channel into which a portion of a mounted sanding belt may be wedged, creating a concave sanding surface, that can then be used to produce more uniformly rounded edges and corners.

The housing is made of a resilient, compressible material, while the base plate is of a rigid structure.

The tool incorporates a way for placing and tensioning continuous sanding belts on it by simply swiveling the base plate that is attached to the bottom of the housing, which by such rotational positioning compresses the compressible material of the housing, or releases it, thus applying or releasing tension on a mounted belt.

4 Claims, 3 Drawing Sheets

CONTOURING HAND SANDER TOOL

This application claims the benefit of U.S. Provisional Application No. 60/292,442 filed on May 21, 2001.

This invention relates to a hand held tool for holding and using a continuous sanding belt for sanding and smoothing operations, and for producing more uniform rounding of edges and corners of work surfaces.

BACKGROUND

Although sanding blocks and the like have long provided certain advantages over the unsupported use of sand paper, rigid flat blocks while good for use on flat surfaces are often less than ideal when used to create rounded edges and corners of work objects.

A review of the hand held devices available today indicates that a more accommodating tool for such rounding operations would be useful to craftsmen.

OBJECTIVES

Consequently, the major objective of this invention has been to devise such a tool using continuous sanding belts that, in addition to sanding and smoothing flat surfaces, can provide a way to more uniformly round edges and corners of work pieces.

A second and useful objective of this invention has been to incorporate into the tool's design a unique but simple way to quickly place and remove a continuous sanding belt from the tool.

Further objects and advantages of my invention will become apparent from consideration of the drawings and ensuing descriptions.

LISTING OF FIGURES

| DRAWING REFERENCE NUMBERS: |
|---|
| 20 sander housing; |
| 22 base plate; |
| 24 rotational coupling means; |
| 26 continuous sanding belt; |
| 28 deep channel; |
| 30 rounded ends; |
| 32 rounded profile. |

DESCRIPTION

Referring to the figures a hand operated sanding tool is shown which may be grasped partly around its girth with one hand. It is composed of two parts, a single piece sander housing 20, and a rigid flat bottom base plate 22. The sander housing is made from a compressible, resilient, material.

Figure 1:
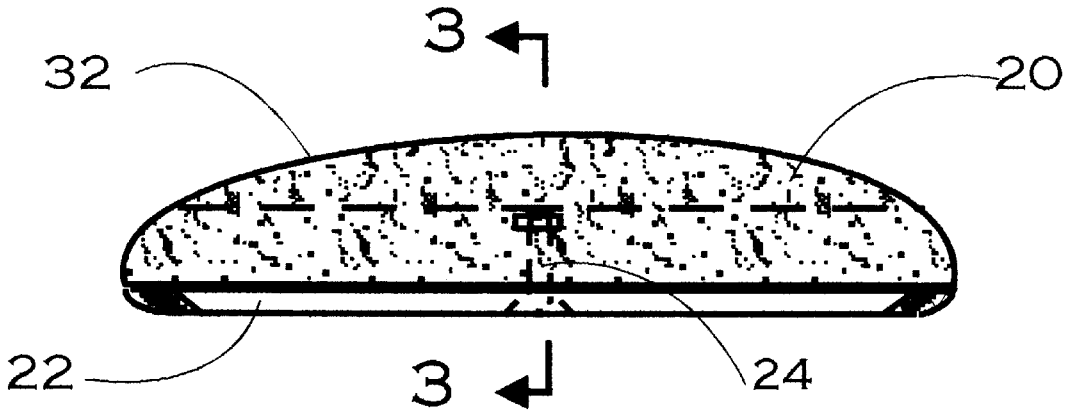
FIG. 1 shows a side view of this invention minus the belt.
Figure 2:
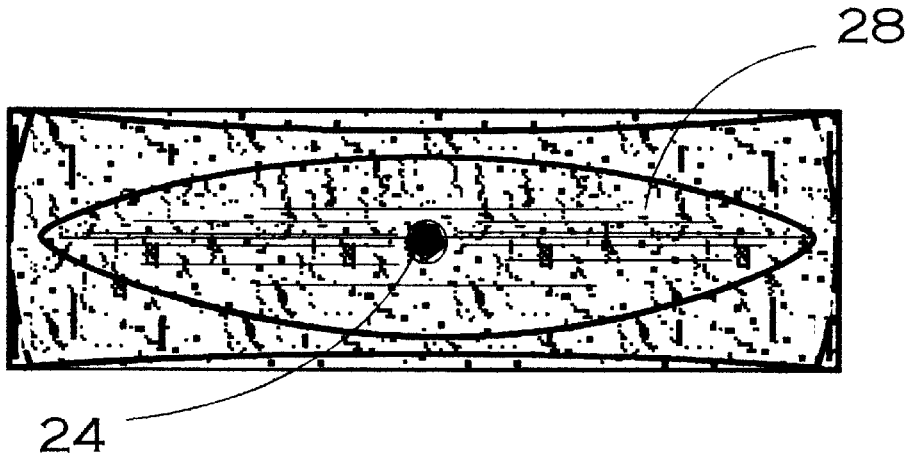
FIG. 2 shows a top view of tool minus the belt.

When viewed from the side, as shown in FIG. 1, the sander housing has a rounded profile 32, over its length tapering down at both ends to meet the base plate whose overall dimensions are generally the same as the housing, where they contact each other. However, they do differ in that the base plate has rounded ends 30. Along the rounded profile of the top of the sander housing is a deep channel 28, centrally aligned, having its trough run parallel to the flat bottom of the housing.

Figure 3:
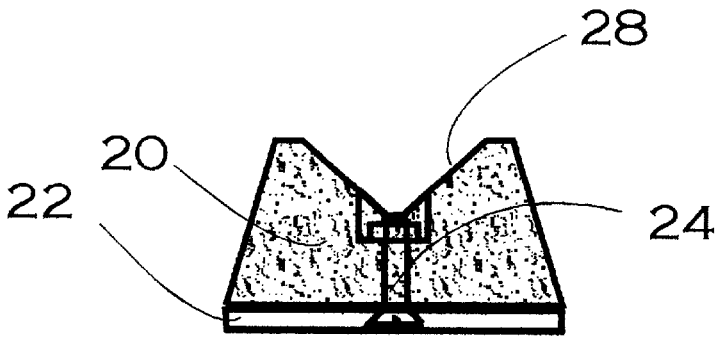
FIG. 3 shows a sectional view of a deep channel in the tool taken along line 3—3 of FIG. 1.

Along the housings length both sidewalls are slightly tilted in toward each other, being closer together at the top of the housing, as shown in FIG. 3, thereby enhancing an easy grip of the tool.

The two parts of the sander are held closely together with a single, centrally located bolt, or equivalent, 24, passing up through both pieces and tightened so as to allow the base plate to be easily rotated.

Operation

Positioning and holding a continuous sanding belt on a sanding tool so it won't slip when being used requires some kind of a tensioning mechanism to be incorporated in the tools design. The following describes a simple but effective way to do this.

Figure 4:
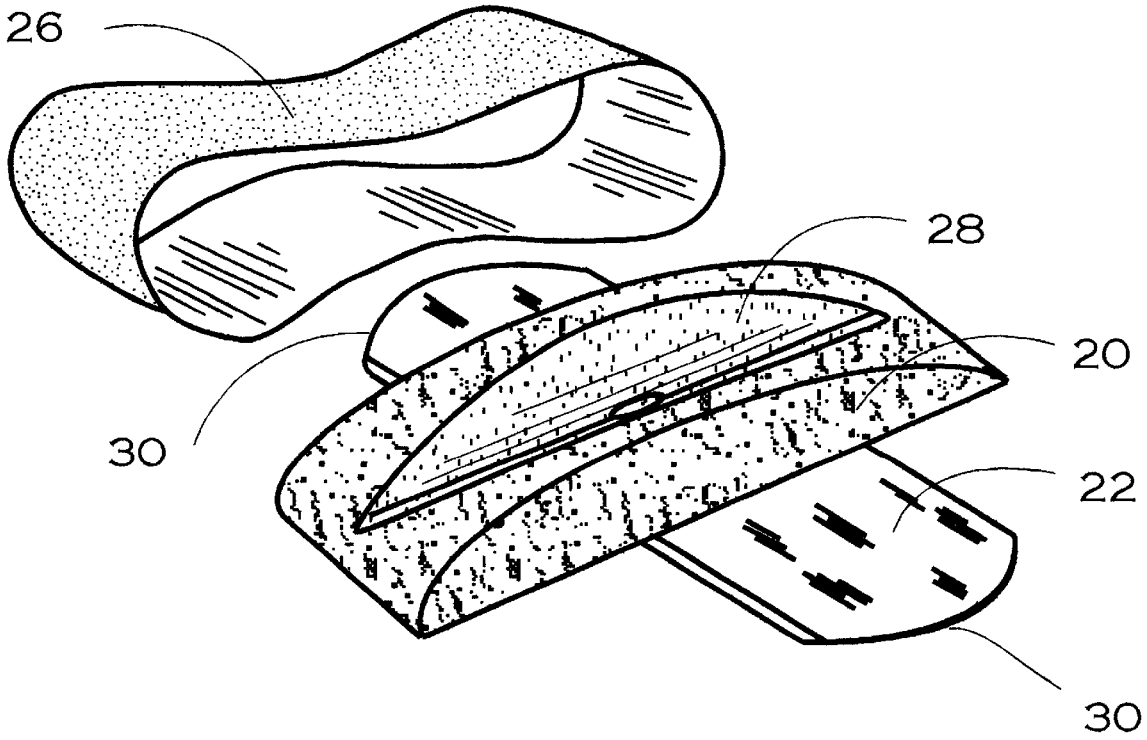
FIG. 4 shows a perspective view of the tool with its base plate rotated to the open position, and a belt in position to be mounted.
Figure 5:
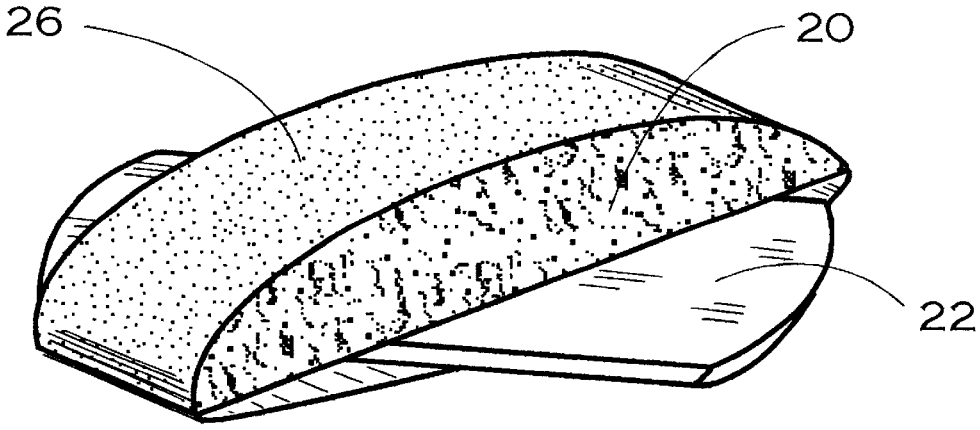
FIG. 5 shows a perspective view of the tool with belt loosely mounted having its base plate partially rotated back toward a closed, longitudinally aligned position with the sander housing.
Figure 6:
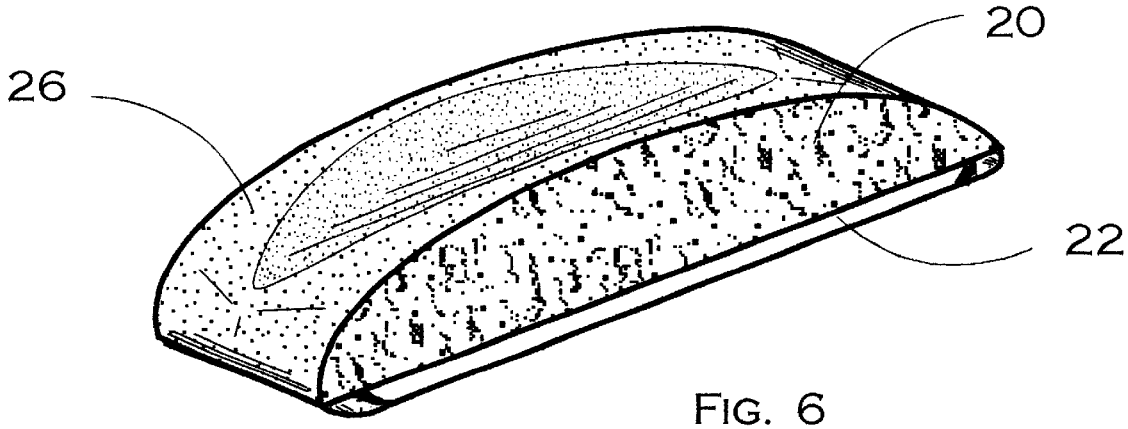
FIG. 6 shows a perspective view of the tool with its base plate closed, such that it is fully aligned with the sander housing. Also, the sanding belt is shown creased down into the channel of the housing.

The bottom base plate of the tool, which is free to turn, is rotated about ninety degrees with respect to the upper sander housing portion, as seen in FIG. 4. When in this position a side view of the tool reveals that its overall circumferential distance, around which the belt contacts, is minimized. A belt may then be placed over the tool and tensioned by rotating the base plate back toward its original inline alignment with the upper housing, as seen in FIG. 5. When fully aligned, as seen in FIG. 6, the distance around the tool, in contact with the belt, will be maximized as will be the tension on the belt because the compressible resilient material of the housing, around which the belt is placed, is squeezed and in such a compressed state applies pressure to expand the belt thus creating a tension.

Figure 7:
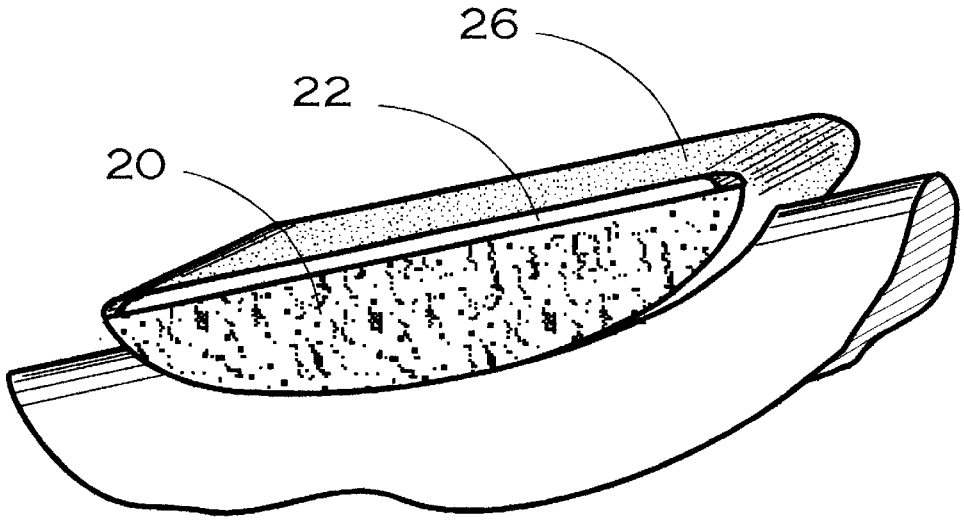
FIG. 7 is a perspective view of the tool in action, rounding the edge of a work Piece.

When the tool is used for rounding edges, as shown in FIG. 7, the action is to move the sander back and forth in a longitudinal direction. No careful sideways motions or sanding techniques are required, as with typical flat faced sanding devices.

Conclusions

In addition to flat surface sanding, the tool may be used to obtain more uniformly rounded edges offering an advantage over existing block sanders.

The belt tensioning mechanism is very simple. It only requires the use of the housing and the swiveling base plate to place and remove sanding belts.

While the base plate must be made of rigid material, the sander housing is made from a resilient, compressible material, such as lightweight foam whose exceptional lightweight makes it especially desirable when used for overhead work.

Although the preferred embodiment of the invention has been presented in the above descriptions these should not be construed as limitations on the scope of the invention, but rather, as an exemplification of one preferred embodiment thereof. Other variations are possible, for example, the shape and extent of the channel in the sander housing or, the location of the rotational coupling means. Accordingly, the scope of the invention should be determined, not by the embodiment(s) illustrated, but by the appended claims and their legal equivalents.

I claim:

1. A hand operated sander tool for use with a continuous sanding belt for rounding edges and corners, as well as, sanding flat surfaces of work pieces, comprising:

an elongated sander housing having a flat rectangular bottom, said housing having a channel extending longitudinally along a top side of said housing, said sander housing being made from a resilient material, a flat base plate, made of rigid material, whose length and width dimensions are substantially the same as that of the said rectangular bottom of the said sander housing, said flat base plate having four corners that are sufficiently rounded, wherein said flat base plate does not extend beyond the overall length and width of said sander housing bottom, and a rotational coupling means for rotatingly coupling said base plate to said sander housing bottom, wherein rotational movement between said base plate and said housing allows mounting and dismounting of said sanding belt.

2. A hand held sanding tool for use with a continuous sanding belt comprising:

an elongated sander housing made from a resilient, compressible material having a flat rectangular bottom, said sander housing having a longitudinal, central channel extending along a top side thereof, a flat base plate located on said bottom side of said sander housing and having substantially the same length and width of said bottom, and having rounded ends, and a fastening means for rotatingly attaching said base plate to said sander housing bottom, such that said base plate can be rotated with respect to said sander housing bottom allowing for mounting and dismounting of said sanding belt.

3. A hand operated sanding tool for use with a continuous sanding belt comprising:

a sander housing having a top and a bottom, wherein said top comprises a channel, a base plate located and aligned with said sander housing bottom, a rotational coupling means by which said base plate is aligned and attached to the said bottom of said sander providing rotational motion there between allowing for mounting and dismounting of said sander belt.

4. The sander housing of claim 3, wherein said housing is made from resilient compressible material and said base plate is made of a rigid material.

* * * * *